United States Patent [19]

Morrison et al.

[11] 4,229,903

[45] Oct. 28, 1980

[54] REMOTE CONTROLLED TALKING AMUSEMENT DEVICE

[75] Inventors: Howard J. Morrison, Deerfield; John R. Wildman, North Riverside, both of Ill.

[73] Assignee: Marvin Glass & Associates, Chicago, Ill.

[21] Appl. No.: 10,807

[22] Filed: Feb. 9, 1979

[51] Int. Cl.[3] ..... A63H 33/26

[52] U.S. Cl. ..... 46/232; 46/44

[58] Field of Search ..... 46/44, 232, 118, 171, 46/175 AR, 153, 123

[56] References Cited

U.S. PATENT DOCUMENTS

| | | | |
|---|---|---|---|
| 2,247,329 | 6/1941 | Deitz | 46/232 |
| 2,324,774 | 7/1943 | Henry | 46/232 |
| 2,700,250 | 1/1955 | Williams | 46/232 |
| 2,942,380 | 6/1960 | Coulter | 46/232 |
| 4,158,931 | 6/1979 | Terzian | 46/232 |

FOREIGN PATENT DOCUMENTS

| | | | |
|---|---|---|---|
| 484592 | 10/1929 | Fed. Rep. of Germany | 46/44 |

*Primary Examiner*—Gene Mancene
*Assistant Examiner*—John J. Wilson
*Attorney, Agent, or Firm*—Mason, Kolehmainen, Rathburn & Wyss

[57] ABSTRACT

A remote controlled talking amusement or entertainment device of an amusing and simple construction includes a pair of fanciful heads mounted on a rigid base. Disposed within the base are an electromechanical transducer or audio speaker for transmitting audible output signals and a pair of fluid actuated pistons or diaphragms for imparting motion to a movable portion of one or both of the fanciful heads to simulate human speech or other sound patterns or facial expressions. The base is functionally interconnected with a remotely disposed control unit that includes a transducer or microphone for receiving audible input signals for transmission by the speaker in the remotely disposed base and also includes a pair of fluid pumps or air bellows for respectively actuating the remotely disposed pistons or diaphragms in the base to thereby impart motion to the movable portions of the fanciful heads either in synchronism or not in synchronism with the audible output signal transmitted by the speaker in the base. Preferably, an amplifier is connected between the microphone and the speaker and may be physically located in either the base or in the control unit.

6 Claims, 3 Drawing Figures

REMOTE CONTROLLED TALKING AMUSEMENT DEVICE

BACKGROUND OF THE INVENTION

A. Field of the Invention

The device of the present invention generally relates to amusement or entertainment devices, and, more particularly, to remote controlled talking amusement devices.

B. Description of the Prior Art

Amusement, entertainment or other devices from which voices or other sounds may be projected are old and well known in the prior art. For example, the following U.S. patents disclose such devices: Nos. 2,247,329; 2,324,774; 2,700,250; 2,942,380; and 3,064,390. In addition, it is well known in the prior art to provide amusement, entertainment and other devices with movable mouths or jaws that are either automatically or manually controlled to simulate speech or other sound patterns or facial expressions. For example, most of the above patents and U.S. Pat. No. 2,114,851 disclose devices having such capabilities. While the devices disclosed in the above-identified prior art patents appear to be capable of adequately performing their intended functions, they are, in general, relatively complex and expensive devices and have limited amusement or entertainment value.

SUMMARY OF THE INVENTION

An object of the present invention is to provide a new and improved amusement or entertainment device.

Another object of the present invention is to provide a new and improved, remote controlled, talking amusement or entertainment device.

Another object of the present invention is to provide a new and improved, remote controlled, talking amusement device that includes one or more fanciful heads, one or more component parts of which are capable of moving under the manual control of one or more remotely positioned operators.

Another object of the present invention is to provide a remote controlled, talking amusement device having a base with a speaker disposed therein for transmitting voices or other audible sounds and a pair of fanciful heads having component parts capable of moving under the control of one or more remotely positioned operators to simulate human speech or other sound patterns or facial expressions.

Briefly, a new and improved, remote controlled talking amusement or entertainment device includes, in the preferred embodiment, a relatively rigid base having an electromechanical transducer in the form of an audio speaker disposed therein for transmitting therefrom an audible output signal, that is voices or other audible sounds, and one or more fanciful heads of toy figures (hereinafter referred to as fanciful heads), integral portions of which are capable of movement either in or not in synchronsim with the audible output signal to simulate human speech or other sound patterns or facial expressions. The amusement device includes a remotely disposed control unit interconnected with the base and having a transducer in the form of a microphone disposed therein for receiving an audible input signal and one or more manually operable, fluid (as used herein, the term fluid is meant to include within its scope air, any other gas, or a liquid) pumps or, specifically, air bellows for actuating and controlling the movement of one or more pistons or diaphragms disposed in the base which impart motion to the moving portions of the fanciful heads. An electrical amplifier, for example, a conventional battery powered audio amplifier, is physically disposed within the base (or, if desired, within the remotely disposed control unit) for amplifying the converted input signal for subsequent transmission as the audible output signal.

BRIEF DESCRIPTION OF THE DRAWING

The above and other objects and advantages and novel features of the present invention will become apparent from the following detailed description of the preferred embodiment of the present invention as illustrated in the accompanying drawing wherein.

DESCRIPTION OF THE PREFERRED EMBODIMENT

Figure 1:
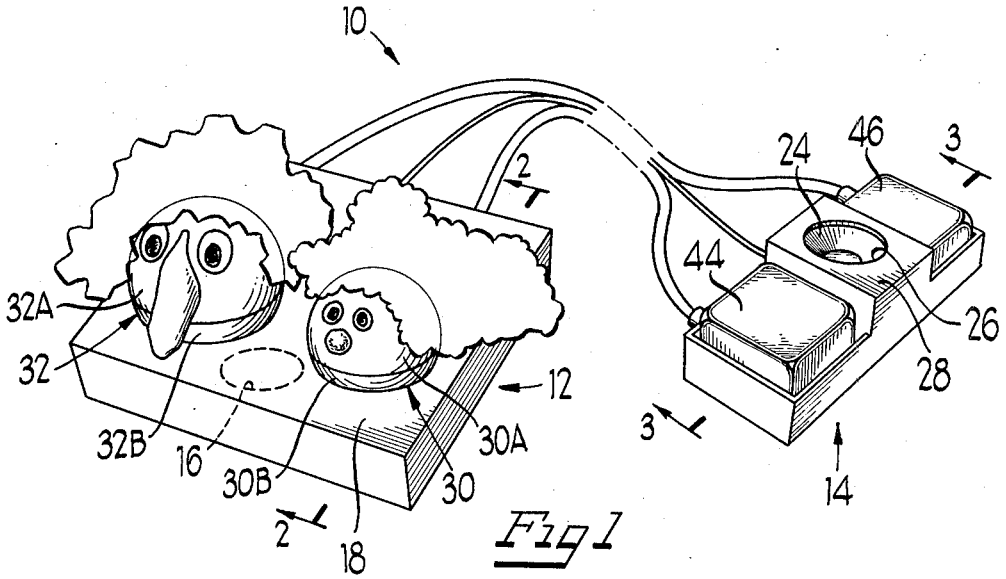
FIG. 1 is a perspective view of an amusement device constructed in accordance with the principles of the present invention.
Figure 2:
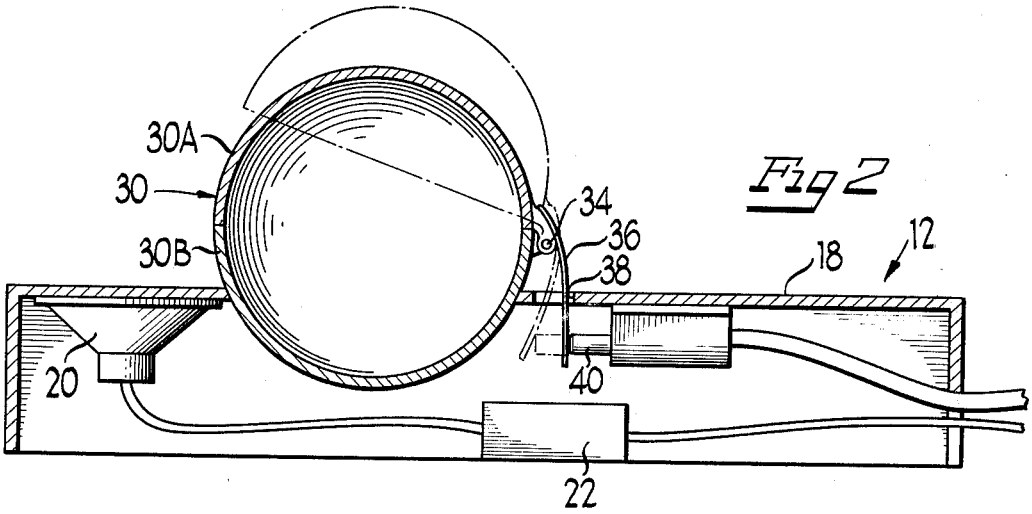
FIG. 2 is an enlarged, cross-sectional view of a base of the amusement device of FIG. 1 taken along line 2—2 of FIG. 1.
Figure 3:
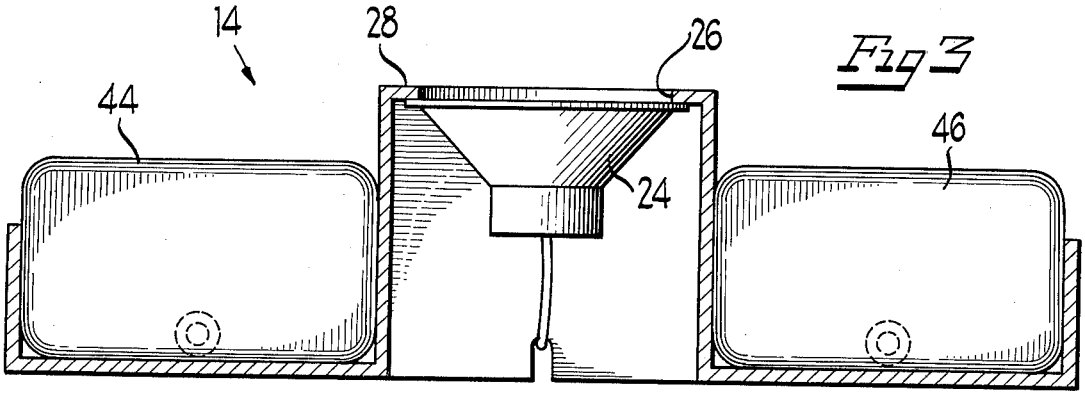
FIG. 3 is an enlarged, cross-sectional view of a remotely disposed control unit of the amusement device of FIG. 1 taken along line 3—3 of FIG. 1.

In accordance with an important feature of the present invention, a new and improved, remote controlled, talking amusement or entertainment device 10 (FIGS. 1–3) includes a base 12 and a remotely disposed control unit 14, both of which, in the preferred embodiment, are formed from a moldable synthetic resin to form relatively rigid structures. Mounted below an aperture 16 in an upper surface 18 of the base 12 is an electromechanical transducer in the form of an audio speaker 20 for transmitting an audible output signal, that is, human voices or other audible sounds, from the base 12. In accordance with the preferred embodiment, an electrical amplifier, for example, a conventional battery powered, audio amplifier 22, is mounted within the base 12 and is used to amplify a converted, audible input signal to a transducer in the form of a microphone 24 mounted below an opening 26 in an upper surface 28 of the remotely disposed control unit 14 to provide the audible output signal from the speaker 20.

In accordance with a further important feature of the preferred embodiment of the present invention, the base 12 includes a plurality of two fanciful heads 30 and 32 fixedly attached to the upper surface 18 of the base 12. In the preferred embodiment, the heads 30 and 32 are formed by two component parts 30A and 30B and 32A and 32B that are suitably interconnected, for example, by a hinge 34 (FIG. 2), to permit relative motion therebetween. The head portions 30B and 32B are fixed with respect to the upper surface 18 so that they are immovable during the operation of the amusement device 10. The head portions 30A and 32A are movable with respect to both the head portions 30B and 32B and the upper surface 18 and, when moved during the operation of the amusement device 10, simulate the opening and closing of mouths or jaws to thereby simulate human speech or other sound patterns or facial expressions. Attached to each of the movable head portions 30A and 32A is a relatively rigid, elongated member 36 that extends through an aperture 38 formed in the upper surface 18 of the base 12 and that terminates in proximity to a piston or diaphragm 40 of a fluid actuated drive system. In the preferred embodiment, the piston 40 is moved by the force of the air in the drive system from an at-rest or non-actuated position (illustrated in solid lines in FIG. 2) to an extended or actuated position (illustrated in dotted lines in FIG. 2). When the piston 40 is moved into an extended position, the movable head portion 30A (or 32A) is moved above and away from the fixed head portion 30B (or 32B).

The movement of the piston 40 is under the control of a first fluid pump or air bellows 44 of a plurality of two fluid pumps or air bellows 44 and 46 secured to the remotely disposed control unit 14. The bellows 44 and 46 are manually engageable by an operator at the control unit 14 remotely positioned from the base 12 to impart motion to the movable head portions 30A and 32A to thereby enable the fanciful heads 30 and 32 to simulate human speech or other audible sound patterns, including conversation between the heads 30 and 32, or facial expressions.

In this manner, a new and improved remote controlled talking amusement or entertainment device 10 is provided that enables one or more human operators at a remotely disposed control unit 14 to control the transmission of voices or other audible sounds from the speaker 20 and the movement of the fanciful heads 30 and 32 to simulate human speech or other audible sound patterns or facial expressions.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A children's amusement device useful to improve a child's hand and eye coordination, comprising:

a base, first transducer means secured to said base for transmitting an audible signal from said base, at least two juxtaposed fanciful heads secured to said base, each of said heads having at least one movable head portion, said base having a pair of motive means for independently moving said head portion of each of said heads, a control unit physically separate from said base, said control unit having mounted centrally thereon a second transducer means secured to said control unit for receiving an audible signal, said control unit also having a pair of opposed manually operated actuating means secured to said control unit on either side of said second transducer means, each of said actuating means operative to actuate one of said motive means to selectively move one of said head portions synchronously with respect to said audible output signal, means for functionally interconnecting said base and said control unit for operating said amusement device and for simultaneously enabling said control unit to be physically remotely disposed from said base during operation of said amusement device, said functionally interconnecting means including means for electrically interconnecting said first transducer means and said second transducer means and means for operatively interconnecting said motive means and said actuating means, such that a child can operate said device by speaking into said centrally mounted second transducing means while simultaneously actuating one of said motive means by operating one of said manually operated actuating means with one hand and thereafter actuating the other of said means with the other hand to simulate a conversation between said fanciful heads while all the time speaking into said centrally mounted second transducer means.

2. An amusement device as defined in claim 1 wherein said means for electrically interconnecting said first transducer means and said second transducer means includes an electrical amplifier for amplifying said audible input signal.

3. An amusement device as defined in claim 1 wherein said first transducer means comprises an electromechanical speaker for transmitting audible signals and wherein said second transducer means comprises a microphone.

4. An amusement device as defined in claim 1 wherein said actuating means utilizes a fluid medium for actuating said motive means.

5. An amusement device as defined in claim 4 wherein said fluid medium is air.

6. An amusement device as defined in claim 1 further comprising an elongated substantially rigid depending member securely affixed to said movable head portion and engageable by said motive means for moving said movable head portion, said base including an upper surface with an aperture formed therein, said depending portion extending through said aperture in said upper surface of said base and extending into proximity with said motive means disposed within said base.

* * * * *